US010525698B2

(12) United States Patent
Zocco et al.

(10) Patent No.: US 10,525,698 B2
(45) Date of Patent: Jan. 7, 2020

(54) PRINTING MACHINE INCLUDING MOVABLE AND POSITIONABLE SUPPORTING STATIONS

(71) Applicant: MACHINES HIGHEST MECHATRONIC GMBH, Erl (AT)

(72) Inventors: Camelo Zocco, Saronno (IT); Robert Zelger, Neiderndorf (AT)

(73) Assignee: Machines Highest Mechatronic GMBH, Erl (AT)

( * ) Notice: Subject to any disclaimer, the term of this patent is extended or adjusted under 35 U.S.C. 154(b) by 0 days.

(21) Appl. No.: 15/531,339

(22) PCT Filed: Nov. 30, 2015

(86) PCT No.: PCT/IB2015/059212
§ 371 (c)(1),
(2) Date: May 26, 2017

(87) PCT Pub. No.: WO2016/084056
PCT Pub. Date: Jun. 2, 2016

(65) Prior Publication Data

US 2017/0320318 A1 Nov. 9, 2017

(30) Foreign Application Priority Data

Nov. 28, 2014 (IT) ..... MI14A002056

(51) Int. Cl.
*B41F 17/00* (2006.01)
*B41F 15/18* (2006.01)
*B41F 33/16* (2006.01)

(52) U.S. Cl.
CPC ..... *B41F 17/005* (2013.01); *B41F 15/18* (2013.01); *B41F 33/16* (2013.01); *B41P 2215/114* (2013.01)

(58) Field of Classification Search
CPC ..... B41F 17/005; B41F 15/18; B41F 33/16; B41P 2215/114; B41J 11/02; B41J 11/06;
(Continued)

(56) References Cited

U.S. PATENT DOCUMENTS

2004/0065220 A1 4/2004 Lan
2015/0191104 A1* 7/2015 Zocco ..... B65G 35/06 104/290

FOREIGN PATENT DOCUMENTS

DE 20 2012007288 U1 8/2012
EP 2 509 791 B1 10/2013

OTHER PUBLICATIONS

International Search Report dated Feb. 11, 2016, issued in PCT Application No. PCT/IB2015/059212 filed Nov. 30, 2015.

* cited by examiner

*Primary Examiner* — Henok D Legesse
(74) *Attorney, Agent, or Firm* — Workman Nydegger

(57) ABSTRACT

Printing machine includes a guide; at least one printing station located along the guide; at least one supporting station for supporting a product to be printed by the printing station; at least a first and a second positioning units mounted along the guide, at least one of the positioning units being located at the printing station. The supporting station includes: a motor substantially integral with the supporting station for moving the supporting station along the guide; an acquisition device capable of acquiring an identification code from each of the positioning units when the supporting station is at each of the positioning units; a memory wherein reference codes corresponding to the identification codes and at least one reference distance corresponding to a distance between the first and second positioning units are stored; a processing unit configured to control the motor
(Continued)

based on the acquired identification codes and on the reference codes and reference distance stored in the memory.

10 Claims, 3 Drawing Sheets

(58) Field of Classification Search
CPC ..... B41J 11/007; B65G 17/123; B65G 17/12; B65G 17/48; B65G 17/06; B65G 37/00; B65G 21/20; B65G 21/2054; B65G 21/22
See application file for complete search history.

PRINTING MACHINE INCLUDING MOVABLE AND POSITIONABLE SUPPORTING STATIONS

BACKGROUND OF THE INVENTION

The present invention refers to a printing machine.

In particular, the present invention refers to an oval textile screenprinting machine.

However it has to be understood that the invention can be applied also to other types of printing machines.

STATE OF THE ART

As known, printing machines can comprise a plurality of printing stations arranged along a circular or elliptical rail.

A determined number of support stations, adapted to support products to be printed, are moved along the rail, so as to sequentially bring the products at each station.

In some machines, each support station is provided with an independent motor, which drives the support station along the rail independently of the other support stations.

In order to stop at each printing station and properly positioning the product with respect to the printing devices, each supporting station comprises a sensor adapted to detect a braking reference, positioned at each printing station: when the braking reference is detected, the supporting station is stopped and the its position is possibly corrected by a mechanical positioning device (e.g., fixed pin).

The Applicant has noticed that the operation of this type of machines is not optimized, since the speed at which each supporting station is moved must necessarily be quite low, so as to allow each drive system to stop the supporting station after the braking reference is detected. This causes significant limitations of the printing rate of this type of machines.

SUMMARY OF THE INVENTION

It is an object of the present invention to provide a printing machine in which the printing rate is maximized.

It is a further object of the present invention to provide a printing machine in which the displacement speed of the supporting station(s) is optimized. In particular said speed is maximized.

It is a further object to provide a printing machine that is capable of constantly check the wear status of each supporting station's components, thereby reducing the risks of malfunctioning and wrong printing.

These and other objects are substantially achieved by a printing machine according to the appended claims.

Further features and advantages will become more apparent from the detailed description of a preferred and non exclusive embodiment of the invention.

BRIEF DESCRIPTION OF THE DRAWINGS

The description is provided hereinafter with reference to the accompanying drawings, given by way of non-limiting example, in which.

DETAILED DESCRIPTION OF THE INVENTION

Figure 1:
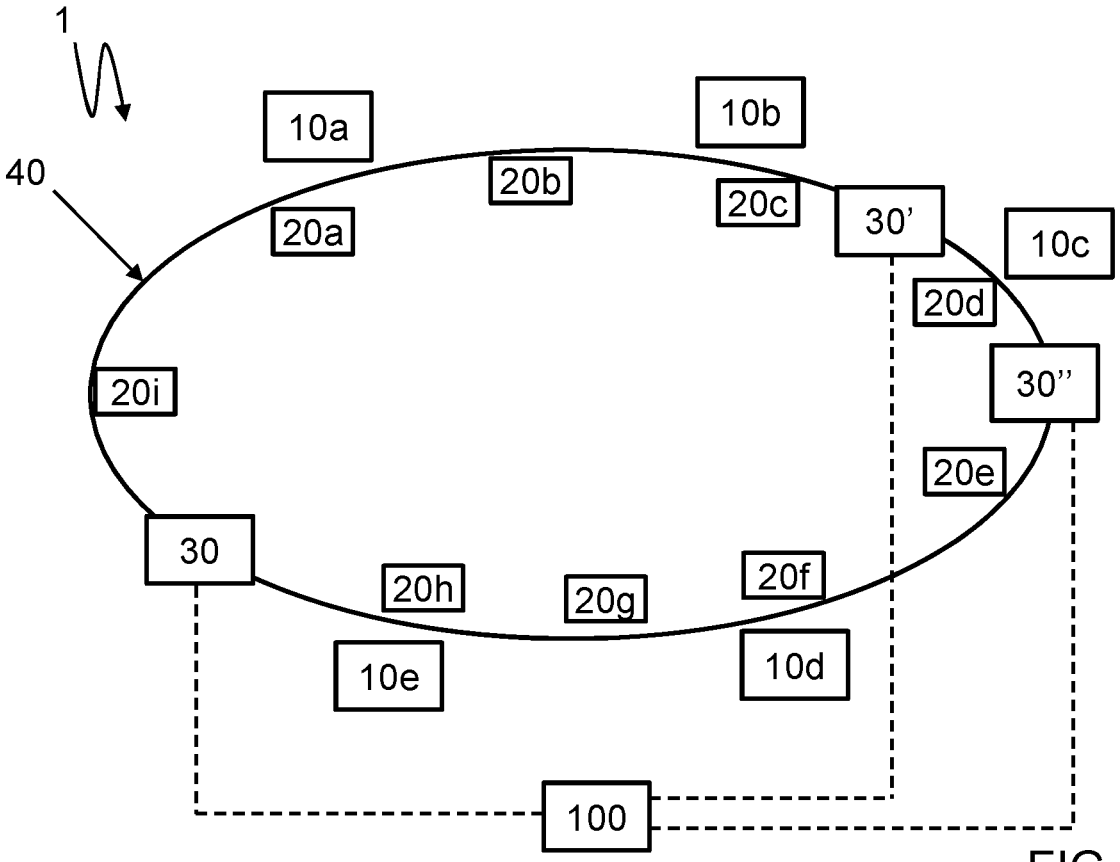
FIG. 1 is a block diagram of a printing machine according to the invention.

With reference to the accompanying drawings, a printing machine according to the invention has been generally denoted with reference numeral 1.

The printing machine 1 is preferably an oval textile screenprinting machine.

However it has to be noted that the printing machine 1 can be any printing machine wherein one or more supporting stations are moved relative to a plurality of printing stations.

The printing machine 1 comprises at least a printing station 10*a*.

Preferably the printing machine 1 can comprise a larger number of printing stations; in the example of FIG. 1 it further comprises printing stations 10*b*-10*e*. Each printing station basically includes the same general features of printing station 10*a*.

The printing station 10*a* can be a screen printing station, a digital printing station, an additional equipment (e.g., dryer, flock unit, cooling station, foil unit, . . . ).

The printing machine 1 further comprises a guide 40 along which the printing station 10*a*, and possibly printing stations 10*b*-10*e*, are located.

Preferably the guide 40 is a rail.

Preferably the guide 40 defines a close path, having for example an oval, elliptical or circular shape.

In one embodiment, the guide 40 is formed by a pair of substantially rectilinear sections, the ends of which are joined through a couple of curved sections, having for example a semi-circular or semi-elliptic shape.

The printing machine 1 further comprises at least a first and second positioning units 20*a*, 20*b* mounted along the guide 40.

Preferably the printing machine can further comprise additional positioning units; by way of example, FIG. 1 shows additional positioning units 20*c*-20*i*. Each additional positioning unit comprises the same features as the first and/or second positioning unit 20*a*, 20*b*.

At least one of the positioning units 20*a*, 20*b* is located at the printing station 10*a*.

Preferably, each printing station 10*a*-10*e* is associated with a respective positioning unit, which is mounted in the proximity of the corresponding printing station.

Preferably, one or more positioning units are mounted in positions where no printing stations are provided.

The latter can be advantageously provided for several reasons (that will become more clear in the following):

- it can be necessary to stop the supporting stations (which will be described in the following) in one or more positions, even if no printing or treatment is carried out, just to avoid collisions with other supporting stations;
- external units, other than printing stations (e.g., dryers or other external devices) have to operate on the products to be printed (or which have just been printed) supported by the supporting stations; such units will be arranged where no printing station is mounted, and a positioning unit will be necessary in order to have the supporting stations stop at the right spot.

The first and second positioning units 20*a*, 20*b* make available respective identification codes ID1, ID2.

For example, each of the first and second positioning units 20*a*, 20*b* can comprise a label, which bears the respective identification code ID1, ID2 in the form of a sequence of pins, of a bar code, of a QR code, etc.

Accordingly, a plurality of positions along the guide 40 can be identified.

The printing machine 1 further comprises at least one supporting station 30 for supporting a product to be printed.

The product can be, for example, a textile product.

Preferably the printing machine 1 comprises a plurality of supporting stations, each adapted to support a respective product to be printed.

By way of example, FIG. 1 schematically shows also supporting stations 30', 30".

Each supporting station preferably has the same structure and operating capabilities of the supporting station 30 that will be disclosed in the following.

The supporting station 30 preferably comprises a table (not shown), on which the product to be printed is arranged.

The supporting station 30 is mechanically associated with the guide 40 in a manner that is per se known and that will not be described in detail.

An example of how the supporting station 30 is mounted on the guide 40 is disclosed in EP 2 509 791 B1; in this document the supporting station is referred to as "Druckgutträger 40" and the guide is referred to as "Führungsbahn 20".

Figure 2:
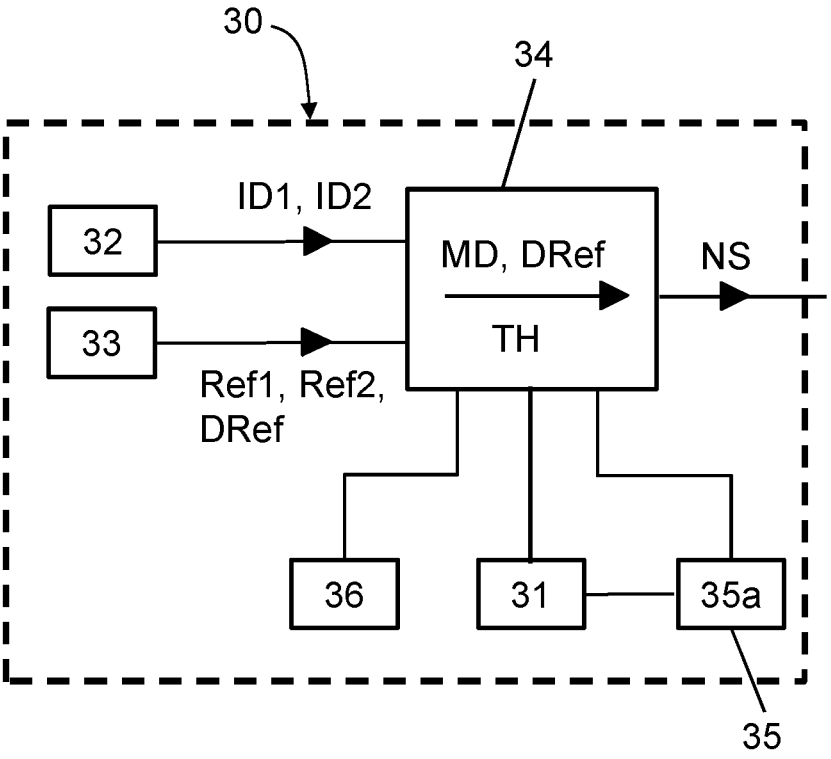
FIG. 2 is a block diagram of a part of the machine of FIG. 1.

Advantageously the supporting station 30 (FIG. 2) comprises a motor 31.

The motor 31 is substantially integral with the supporting station 30.

The motor 31 is adapted to move the supporting station along the guide 40.

In other words, the motor 31 moves with the supporting station 30 along the guide 40; this means that the supporting unit 30, including the motor 31 and other elements that will be disclosed in the following, moves as a single body along the guide 40, driven by the motor 31. For example the motor 31 can be a linear motor, the stator of which is integral to the guide and the rotor is mounted to the supporting station.

Preferably the motor 31 is an electric motor, in particular a step motor.

The general operation of motor 31 is disclosed in the aforementioned document EP 2 509 791 B1.

Preferably the motor 31 and possibly the other electrical parts of the supporting station 30 are power supplied through the guide 40: a power line can be arranged along the guide 40 and the supporting station 30 can be provided with sliding contacts that keep the circuits of the same supporting station 30 in contact with the power line during functioning and displacement of the supporting station.

The supporting station 30 further comprises an acquisition device 32 capable of acquiring an identification code ID1, ID2 from each of the positioning units 20*a*, 20*b* when the supporting station 30 is at each of the same positioning units 20*a*, 20*b*.

In other terms, when the supporting station 30 is positioned at each positioning unit, the acquisition device 32 can read/receive the identification code ID1, ID2 associated with the relevant position of the positioning unit on the machine.

The label of the positioning units 20*a*, 20*b* is so arranged that, when the supporting station 30 reaches the positioning units 20*a*, 20*b*, the acquisition device 32 substantially faces said label, so as to read the relevant identification code.

The supporting station 30 further comprises a memory 33 wherein reference codes Ref1, Ref2 corresponding to the identification codes ID1, ID2, and at least one reference distance DRef corresponding to a distance between said positioning units 20*a*, 20*b* are stored.

As it will be more clear in the following, the reference codes Ref1, Ref2 and the reference distance DRef can be advantageously detected/determined and stored by the supporting station 30 during an initial self-learning operation.

The supporting station 30 further comprises a processing unit 34 configured to control said motor 31 based on the acquired identification codes ID1, ID2 and on the reference codes Ref1, Ref2 and reference distance DRef stored in the memory 33.

In particular, the processing unit 34 supplies said motor 31 with stop commands based on the reference distance DRef.

Preferably, the processing unit 34 regulates the speed at which the motor 31 moves the supporting station 30 from the first positioning unit 20*a* to the second positioning unit 20*b* based on the reference distance DRef.

For example, if the distance between the first and the second positioning units 20*a*, 20*b* (i.e., the reference distance DRef) is quite short, the maximum speed that will be reached is quite low. By contrast, if the distance between the first and second positioning units 20*a*, 20*b* is quite long, the maximum speed that will be reached can be higher.

A numeric example will be provided in the following so as to further clarify this feature.

Advantageously the supporting station 30 further comprises a measuring unit 35 capable of determining a distance travelled by said supporting station 30 along said guide 40.

Preferably the measuring unit 35 includes an encoder 35*a* associated to the motor 31.

For example, the encoder 35*a* can be associated with an output shaft of motor 31 in order to count the number of revolutions or steps of such output shaft and to convert this number into a distance measurement based on a preset conversion factor (e.g., 1 step corresponds to 0.077 millimeters).

Preferably the processing unit 34 cooperates with the measuring unit 35 in order to control the movement of the supporting station 30 along the guide 40 based on the reference distance DRef.

In particular, given the reference distance DRef, which is the distance that the supporting station 30 is supposed to travel, the processing unit 34 activates the motor 31 so as to start movement of the supporting station 30.

By means of the measuring unit 35, the processing unit 34 is informed (for example constantly or periodically) of the distance travelled by the supporting station 30 until that moment.

When the measured distance is substantially equal to the reference distance DRef, the processing unit 34 commands the motor 31 to stop.

In more detail, the processing unit 34 defines, based on the reference distance DRef, a speed profile that will be followed by the motor 31. In this profile, as said above, higher speeds can be set in case of longer distances.

The speed profile thus includes acceleration/deceleration sections, which cause the motor 31 to drive the supporting station 30 from the first positioning unit 20*a* to the second positioning unit 20*b*.

The aforementioned stop command can correspond to a value equal to zero at the end of the speed profile.

Preferably each positioning unit 20*a*, 20*b* is provided with a positioning mechanism 50 (FIGS. 4*a*-4*b*) that adjusts the position of the supporting station 30 when the latter is in the proximity of a positioning unit. The positioning mechanism 50 is helpful since, sometimes, the position of the supporting station 30 determined based on the measuring unit only is not sufficiently precise, and a minor adjustment is necessary.

For example, the positioning mechanism 50 can include a pin 51 adapted to engage a respective engagement portion 37 provided in the supporting station 30.

Figure 4A:
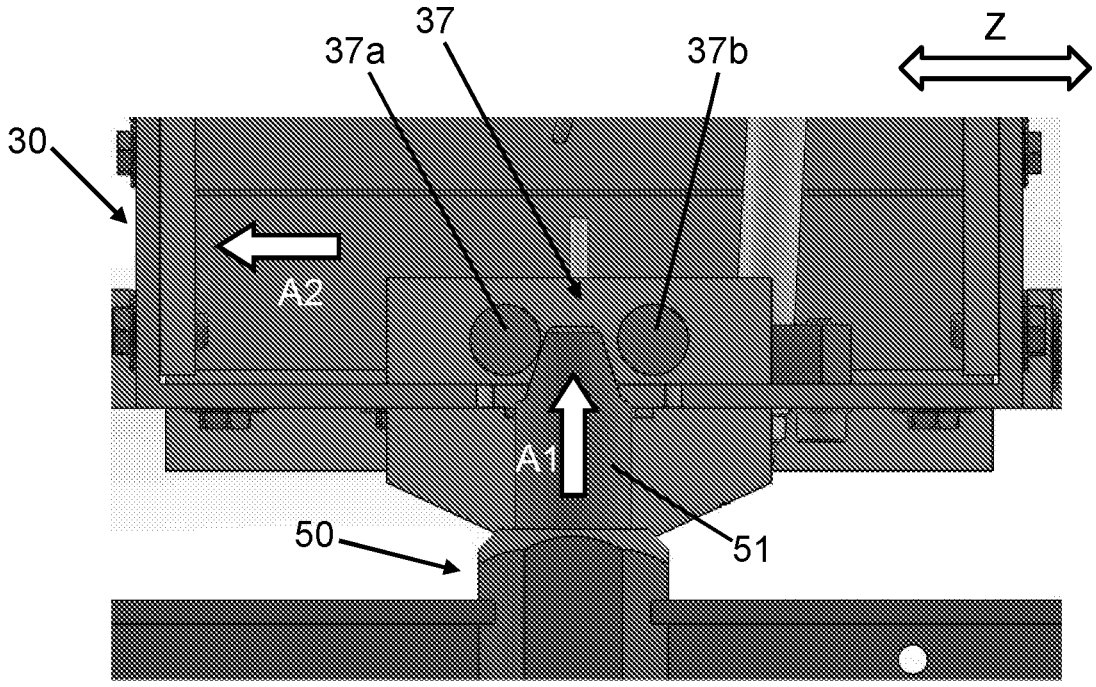
FIGS. 4*a*-4*b* schematically show details of the printing machine of FIG. 1 in different operating conditions.
Figure 4B:
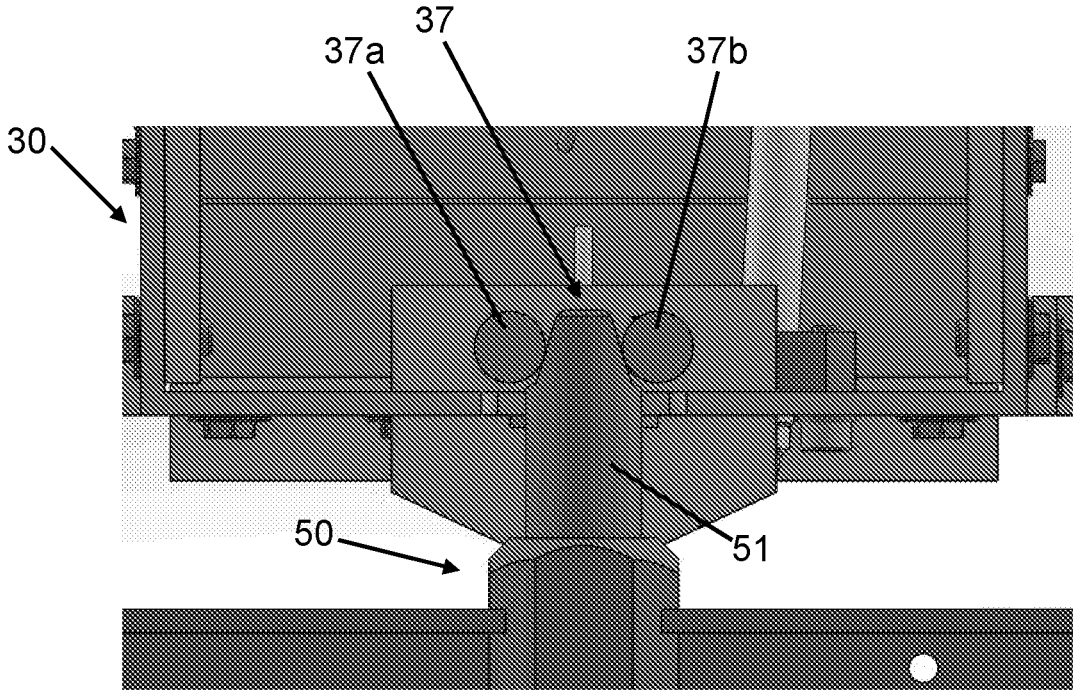

The pin 51 has a tapered top portion 51*a*, as shown in FIGS. 4*a*-4*b*.

The pin 51 is pushed, by means of a suitable pushing element (not shown), such as a pneumatic cylinder, an electrical actuator or a mechanical element such as a spring, for example, towards the supporting station 30.

Engagement portion 37 includes a cavity/hole or, for example, a couple of horizontal counterpins 37*a*, 37*b*. The horizontal counterpins 37*a*, 37*b* preferably have a longitudinal axis substantially orthogonal to the movement direction of the supporting station 30 (arrow Z in FIG. 4*a*) and to the longitudinal axis of the pin 51, as shown in FIGS. 4*a*-4*b*.

Accordingly, if the pin 51 is not precisely and completely inserted in the engagement portion 37, thanks to the action of the pushing element and its tapered top portion 51*a*, it tends to cause a small additional displacement of the supporting station 30.

FIG. 4*a* schematically shows a situation in which the pin 51 is not completely inserted between counterpins 37*a*, 37*b*; in this example, the pin 51 is pushed upwards (arrow A1) and the inclined surface of its tapered top portion 51*a* pushes the support station 30 leftwards (arrow A2).

In FIG. 4*b* the pin 51 is properly inserted between counterpins 37*a*, 37*b*. For example, the situation of FIG. 4*b* can be subsequent in time with respect to the situation of FIG. 4*a*: following the additional displacement of the supporting station 30, the pin 51 is now capable of properly engage the engagement portion 37 (e.g. is completely and precisely inserted between counterpins 37*a*, 37*b*). As a consequence, the supporting station 30 is suitably positioned at the relevant positioning unit.

It has to be noted that other systems, per se known, can be used in order to adjust the position of the supporting station 30 after it has travelled a distance substantially equal to the reference distance DRef.

Preferably, the supporting station 30 further comprises an additional sensing device 36 capable of detecting additional movements of the same supporting station 30; such additional movements are preferably not caused by activations of the motor 31.

In particular, the additional movements can be caused by the positioning mechanism 50 of one of the positioning units 20*a*, 20*b*, which acts (for example tending to insert the aforementioned pin into the suitable engagement portion 37 of the supporting station 30) to make the same supporting station 30 reach the exact position at the positioning unit.

Preferably the processing unit 34 is configured to cooperate with the measuring unit 35 and the additional sensing device 36 to determine a measured distance MD travelled by the supporting station 30 from the first positioning unit 20*a* to the second positioning unit 20*b*.

The measured distance MD can be different from the reference distance DRef; this can be due to the further displacement managed in cooperation with the aforementioned positioning mechanism.

Advantageously, the processing unit 34 is configured to store the measured distance MD, and to compare such stored information with a measured distance determined the next time the supporting station 30 moves from the first positioning unit 20*a* to the second positioning unit 20*b*.

Preferably this comparison is performed every time the supporting station 30 moves from the first positioning unit 20*a* to the second positioning unit 20*b*; advantageously, the comparison takes into consideration the trend of the measured distance MD time after time.

If the measured distance MD calculated at a certain time is too different from the measured distance determined at the first time (i.e., the difference exceeds a predetermined threshold), the processing unit 34 generates a notification signal NS: this can be an indicator that some mechanical parts are worn and need undergo a maintenance process.

Preferably, the supporting station 30 is configured to perform a self-learning operation in order to retrieve the initial data to be stored in the memory 33, namely the reference codes Ref1, Ref2, and the at least one reference distance DRef.

Thus the self-learning operation is performed before the printing machine 1 starts its actual printing activity.

For example, the self-learning operation can be performed the very first time the printing machine is installed, and/or after one or more printing stations and/or positioning units have been added/moved/removed.

In general terms the self-learning operation aims at collecting the reference data (reference codes and reference distance/s) necessary for controlling the movement of the supporting station 30 during the printing activity of the printing machine 1.

In more detail the self-learning operation carried out by the supporting station 30 comprises the following steps, which are preferably performed in the order in which are presented hereinafter:

a. the processing unit 34 controls the motor 31 for moving the supporting station 30 along the guide 40 so as to sequentially reach each of the positioning units 20*a*, 20*b;* b. when the supporting station 30 is at the first positioning unit 20*a*, the acquisition device 32 acquires the identification code ID1 of the same first positioning unit 20*a;* c. the processing unit 34 stores in the memory 33 the acquired identification code as a first reference code Ref1;

d. the processing unit 34 controls the motor 31 so as to move the supporting station 30 away from the first positioning unit 20*a* along the guide 40;

e. when the supporting station 30 is at the second positioning unit 20*b*, the acquisition device 32 acquires the identification code ID2 of the second positioning unit 20*b;* f. the processing unit 34 stores in the memory 33 the acquired identification code as a second reference code Ref2;

g. the processing unit 34 determines the distance between the first and second positioning units 20*a*, 20*b* and stores said distance in said memory 33 as a reference distance DRef.

Preferably, the distance between the first and second positioning units 20*a*, 20*b* is determined by the processing unit 34 cooperating with the measurement unit 35 and the additional sensing device 36.

Then the processing unit 34 commands the motor 31 to further move along the guide 40, in order to reach the subsequent positioning unit.

For each subsequent positioning unit 20*c*-20*i*, the supporting station 30 performs the same steps performed at the second positioning unit 20*b*.

When the supporting station 30 reaches the positioning unit from which the self-learning operation started (in the present case, the first positioning unit 20*a*), the processing unit 34 calculates and stores the distance between the last positioning unit (positioning unit 20*i* in FIG. 1) and the current positioning unit (for example the first positioning unit 20*a*); then the self-learning operation can be considered finished and the printing machine 1 can begin its actual printing activity.

Accordingly, at the end of the self-learning operation, in the memory 33 of the supporting structure 30 the following data are stored:

Identification code of each positioning unit;

Distance between each positioning unit and the following one.

Advantageously a central control unit 100 is provided, which controls and synchronizes the operations and the movements of the supporting station(s).

Preferably the connection between the central control unit 100 and the supporting station(s) is based on the aforementioned power line and the sliding contacts provided on each supporting station.

In one embodiment, some of the positioning units 20*a*-20*i* can be arranged in such a way as to form a sort of "parking zone": a subset of the positioning units are positioned quite close to each other (not close enough to have the supporting stations collide with one another, though) so that the supporting stations reaching these positioning units can be gathered in a small space. When going through the parking zone, each supporting station moves slower since it has to stop continuously in a short distance and it takes longer to reach the end of this area.

This solution can be advantageous, for example, in case a printing station larger than usual is mounted along the guide. This station will need more space; the latter can be obtained by realizing the parking zone right in front of the same printing station.

Another solution in which the parking zone can be advantageously adopted is where a special treatment has to be carried out on the products to be printed (or which have just been printed); the products located on the parked supporting stations can be treated simultaneously.

From a general point of view, it is to be noticed that the number of positioning units is preferably equal or larger than the number of supporting stations. In this way each supporting station can properly control its displacement without colliding with other supporting stations.

In view of the above, the operation of the printing machine 1 is disclosed hereinafter.

Initially the self-learning operation is performed.

In particular it is performed because it is the very first time that the printing machine 1 and/or the supporting station 30 is used, and the memory 33 does not contain any reference data, or because the arrangement of the printing stations and/or of the positioning units has been modified (addition/displacement/removal of one or more printing stations and/or positioning units), so that the reference data previously stored in the memory 33 are obsolete and need to be updated.

If the printing machine 1 comprises more than one supporting station, the self-learning operation is preferably carried out by each supporting station. Preferably, all the supporting stations carry out the self-learning operation substantially simultaneously; for example each supporting station starts from a different positioning unit than the other supporting station/s. Accordingly, all the supporting stations will be moving simultaneously along different sections of the guide 40, stopping at each positioning unit in order to progressively retrieve/determine all the necessary reference data.

As said, at the end of the self-learning operation, in the memory of each supporting station the reference codes and the reference distance/s are stored.

Then the actual printing activity of the printing machine 1 can be initiated.

The products to be printed are arranged on the supporting station/s.

Then the supporting station, if it is not in the correct position at a printing station, moves (or is manually placed) at the printing station that, according to the printing process, is the first that must operate on the product.

Once the printing operation of this printing station is finished, the supporting station moves along the guide 40 towards the subsequent printing station; in other terms, the supporting station moves in one of the two possible directions (clockwise—counterclockwise) along the guide 40.

The direction can be determined, for example, based on a comparison between a printing program, loaded in the memory 33, and the sequence of reference codes.

The movement of the supporting station from the current printing station to the next printing station is actuated by the motor 31 and controlled by the processing unit 34.

In particular, based on the reference distance between the current printing station and the next printing station, the processing unit 34 determines a speed profile to be followed during the displacement.

Preferably, the speed profile (drawn in a speed vs. time diagram) has a substantially triangular shape, which indicates that the speed is increased in a substantially constant way (substantially constant acceleration) for a determined time, and a maximum speed is reached. Then the speed is decreased with a symmetric deceleration, so that the supporting station is stopped at the next printing station.

Figure 3:
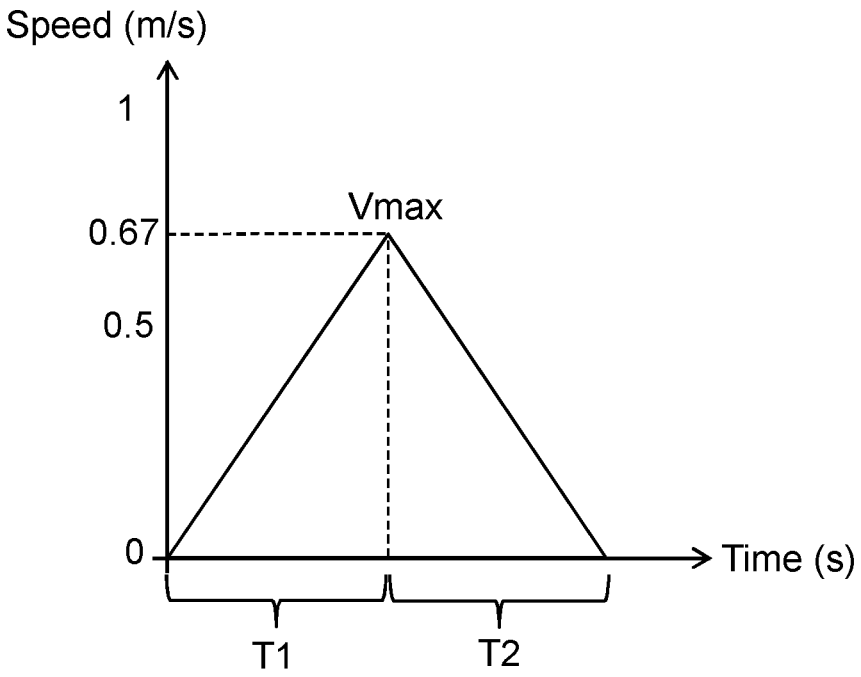
FIG. 3 is a diagram showing parameters used in the printing machine of FIG. 1.

FIG. 3 schematically shows an example of speed profile: the velocity is increased at 0.3 $m/s^2$ for a time T1 and a maximum speed Vmax of about 0.67 m/s is reached. Then the speed is decreased at −0.3 $m/s^2$ for a time T2, which is substantially equal to T1, and the supporting station will stop after a time T1+T2 having travelled a distance that is approximately 3 m.

Preferably, the processing unit 34 can employ different acceleration/deceleration values depending on the dimensions of the supporting station 30.

For example, for a large supporting station, an acceleration/deceleration of 0.2 $m/s^2$ can be used; for a medium size supporting station, an acceleration/deceleration of 0.3 $m/s^2$ can be used; for a small supporting station an acceleration/deceleration of 0.4 $m/s^2$ can be used.

Given a distance to be travelled of 3 m, a large supporting station will need about 5.5 s; a medium size supporting station will need about 4.47 s; a small supporting station will need about 3.87 s.

Given a distance of 7 m, the medium size supporting station will need about 6.83 s, which is a very short time in comparison with the about 4.47 s necessary for a 3 m distance.

It has to be understood that the above values are provided by way of non-limiting example, and that different speed profiles/values can be used.

If, when the distance corresponding to the profile speed has been travelled, the supporting station is not in the exact position at the next positioning unit, the relevant positioning mechanism acts so as to properly adjust the position of the supporting station.

When the supporting station is properly positioned, the processing unit 34 compares the travelled distance determined by the measuring unit (taking into consideration the part travelled based on the reference distance) plus the distance measured by the additional sensing device regarding the part travelled due to the positioning mechanism) with the reference distance DRef and/or with the measured distances, relating to the same tract of guide (e.g., between printing station no. X and printing station no. X+1), determined during a previous printing activity.

As said, the processing unit 34 can also determine a trend in the measured distances of the same section.

In case the data show that the measured distance is significantly different (based on a preset difference threshold) from the reference distance and/or from measurement of the same tract made during previous activities, the notification signal NS can be generated: in fact, the incoherence of measurements related to the very same tract (the length of which does not vary in time) can be an indicator that the moving mechanisms of the supporting station are not working properly anymore.

The invention achieves important advantages.

First of all, the speed of supporting station(s) of the printing machine according to the invention is optimized.

In particular the speed of the supporting station(s) can be significantly higher than the speed in known printing machines; this allows an important increase in the printing rate of the machine.

Furthermore the printing machine according to the invention is capable of constantly check the wear status of each supporting station's components, thereby reducing the risks of malfunctioning and wrong printing.

This self-learning system also allows different distances between the positioning units (and furthermore the printing stations) on one machine. For example due to this different sizes of printing stations can be installed on one machine; a sort of "parking zone" with small distances between the supporting stations in front of a zone with special treatment can be realized.

The invention claimed is:

1. A printing machine comprising:

a. a guide;

b. at least one printing station located along said guide;

c. at least one supporting station for supporting a product to be printed by said printing station; and d. at least a first and a second positioning units mounted along said guide, at least one of said positioning units being located at said printing station;

wherein said at least one supporting station includes:

a motor substantially integral with said at least one supporting station for moving said at least one supporting station along said guide;

an acquisition device configured to acquire an identification code from each of said positioning units when said supporting station is at each of said positioning units;

a memory, wherein reference codes corresponding to said identification codes and at least one reference distance corresponding to a distance between said first and second positioning units are stored in said memory; and a processing unit configured to control said motor based on the acquired identification codes and on the reference codes and the at least one reference distance stored in said memory, wherein said at least one supporting station includes a measuring unit configured to determine a distance travelled by said at least one supporting station along said guide, wherein said processing unit determines a distance between said first and second positioning unit based on a measurement of said measuring unit.

2. The printing machine according to claim 1, wherein said processing unit supplies said motor with stop commands based on said reference distance.

3. The printing machine according to claim 1, wherein said processing unit regulates the speed at which said motor moves said at least one supporting station from said first positioning unit to said second positioning unit based on the reference distance between said positioning units stored in said memory.

4. The printing machine according to claim 1, wherein said supporting station is configured to perform a self-learning operation, wherein:

said processing unit controls said motor for moving the at least one supporting station along said guide so as to sequentially reach each of said positioning units;

when the at least one supporting station is at said first positioning unit, the acquisition device acquires the identification code of said first positioning unit;

said processing unit stores in said memory the acquired identification code as a first reference code;

the processing unit controls the motor so as to move the at least one supporting station away from said first positioning unit along said guide;

when the at least one supporting station is at the second positioning unit, the acquisition device acquires the identification code of said second positioning unit;

the processing unit stores in said memory the acquired identification code as a second reference code;

the processing unit determines the distance between the first and second positioning units and stores said distance in said memory as a reference distance.

5. The printing machine according to claim 1, wherein said measuring unit includes an encoder associated to said motor.

6. The printing machine according to claim 1, wherein said at least one supporting station further comprises an additional sensing device configured to detect an additional movement of supporting station, wherein said additional movement are not caused by activations of said motor.

7. The printing machine according to claim 6, wherein said additional movement is caused by at least one positioning mechanism associated with said first positioning unit and/or said second positioning unit.

8. The printing machine according to claim 7, wherein said processing unit is configured to:

compare said measured distance with a respective reference distance and/or with previously determined measured distances stored in said memory;

generate a notification signal based on said comparison.

9. The printing machine according to claim 6, wherein said processing unit is configured to cooperate with said measuring unit and said additional sensing device to determine a measured distance travelled by said supporting station from said first positioning unit to said second positioning unit.

10. The printing machine according to claim 9, wherein said processing unit generates said notification signal if a difference between said measured distance (M-D) and the respective reference distance is larger than a preset threshold.

* * * * *